US007194219B2

(12) United States Patent
Sato et al.

(10) Patent No.: US 7,194,219 B2
(45) Date of Patent: Mar. 20, 2007

(54) IMAGE-FORMING DEVICE HAVING IMAGE-SCANNING UNIT

(75) Inventors: Shougo Sato, Seto (JP); Naoya Kamimura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 217 days.

(21) Appl. No.: 10/849,032

(22) Filed: May 20, 2004

(65) Prior Publication Data

US 2004/0234292 A1 Nov. 25, 2004

(30) Foreign Application Priority Data

May 20, 2003 (JP) ..... 2003-142507

(51) Int. Cl.
*G03G 15/00* (2006.01)

(52) U.S. Cl. ..... 399/81; 399/367

(58) Field of Classification Search ..... 399/81, 399/107, 367

See application file for complete search history.

(56) References Cited

U.S. PATENT DOCUMENTS 4,731,667 A * 3/1988 Watanabe et al.
5,548,379 A 8/1996 Fukuchi et al.
5,792,928 A 8/1998 Sanchis et al.
5,844,687 A * 12/1998 Nagane et al. ..... 399/107
6,110,734 A 8/2000 Sanchis et al.
6,310,035 B1 10/2001 Sanchis et al.
6,321,063 B1 11/2001 Tanaka et al.
6,612,763 B1 9/2003 Yoshihara
6,686,149 B1 2/2004 Sanchis et al.
6,690,901 B2 * 2/2004 Katsuyama et al. ..... 399/107
6,714,756 B2 * 3/2004 Iimuro ..... 399/107
2003/0115628 A1 6/2003 Vincent et al.

FOREIGN PATENT DOCUMENTS

JP A 6-135615 5/1994
JP A 8-211665 8/1996
JP A 8-320636 12/1996
JP 11180614 A * 7/1999
JP B2 3057238 4/2000
JP A 2001-69280 3/2001
JP B2 3205734 6/2001

* cited by examiner

*Primary Examiner*—Susan Lee
(74) *Attorney, Agent, or Firm*—Oliff & Berridge, PLC

(57) ABSTRACT

A multifunction device includes a scanner for scanning an image from an original document, and a printer body provided with an image-forming unit for forming an image on a paper based on image data read by the scanner. The scanner is provided on the front side of the main printer body, and a control panel is integrally provided with a scanner cover, which covers the scanner. This construction enables production of a compact device having a small footprint and enables the user to supply paper to the scanner, remove the discharged original document, and operate the control panel in the same vicinity, thereby improving operability.

25 Claims, 6 Drawing Sheets

RELATED ART

IMAGE-FORMING DEVICE HAVING IMAGE-SCANNING UNIT

BACKGROUND OF THE INVENTION

1. Field of the Invention

The present invention relates to an image-forming device having an image-scanning unit.

2. Description of Related Art

Image-forming devices well known in the art include facsimile machines and copy machines having an image-forming unit and an image-scanning unit mounted on top of the image-forming unit for scanning an image printed on an original document.

One such image-forming device is disclosed in U.S. Pat. No. 6,321,063. As shown in FIG. 1, this patent proposes an image-forming device 150 including an image-forming unit 151, and an automatic document feeder (ADF) 152 disposed on top of the image-forming unit 151.

In this image-forming device 150, a control panel 153 is provided on the top front side of the image-forming unit 151, while the ADF 152 is disposed on the top rear side of the image-forming unit 151.

SUMMARY OF THE INVENTION

However, with the control panel 153 disposed on the front side and the ADF 152 disposed on the rear side of the image-forming unit 151, the image-forming device 150 is bulky and has a large footprint or installation area.

In the image-forming device 150, an original document fed into the ADF 152 may possibly hinder a user's operations on the control panel 153. In order to modify the image-forming device of FIG. 1 to prevent original documents from hindering operations on the control panel 153, a larger installation area will be necessary.

In view of the foregoing, it is an object of the present invention to provide a compact image-forming device that is capable of conserving space and improving operability.

In order to attain the above and other objects, the present invention provides an image-forming device, including: an image-forming unit; an image-scanning portion; a control panel; and a cover. The image-forming unit includes an image-forming portion that forms an image on a recording medium. The image-forming unit is projected down onto an area in which the image-forming unit is installed. The area is divided into a front area and a rear area in a predetermined front-to-rear direction. The image-scanning portion scans an image from an original document. The image-scanning portion is disposed on a front side of the image-forming unit in the predetermined front-to-rear direction. The image-scanning portion is projected in the front area. The image-forming portion forms an image on a recording medium based on image data read by the image-scanning portion. The control panel enables a user to control the image-scanning portion and the image-forming portion. The control panel is disposed on the front side of the image-forming unit in the predetermined front-to-rear direction. The control panel is projected in the front area. The cover is provided integrally with the operating panel and covers the image-scanning portion.

According to another aspect, the present invention provides an image-forming device, including: an image-scanning portion; an image-forming unit; an original document supply tray; an original document discharge tray; a recording medium supply tray; and a recording medium discharge tray. The image-scanning portion scans an image from an original document. The image-scanning portion includes a document conveying portion that conveys the original document in a direction defined between a predetermined front side and a predetermined rear side of the image-scanning portion. The image-forming unit includes an image-forming portion that forms an image on a recording medium based on image data read by the image-scanning portion. The original document supply tray receives an original document to be supplied to the image-scanning portion. The original document discharge tray receives an original document discharged from the image-scanning portion. The recording medium supply tray receives a recording medium to be supplied to the image-forming portion. The recording medium discharge tray receives a recording medium discharged from the image-forming portion. The original document supply tray, the original document discharge tray, the recording medium discharge tray, the image-forming portion, and the recording medium supply tray are arranged in a vertical alignment.

According to another aspect, the present invention provides an image-forming device, including: an image-scanning portion: an image-forming unit; a control panel; and a cover. The image-scanning portion scans an image from an original document. The image-forming unit includes an image-forming portion that forms an image on a recording medium based on image data read by the image-scanning portion, the image-forming unit having a front side and a rear side, a front-to-rear direction being defined to extend from the front side to the rear side and a rear-to-front direction being defined to extend from the rear side to the front side. The control panel enables a user to control the image-scanning portion and the image-forming portion, the image-scanning portion and the control panel being disposed on the front side of the image-forming unit. The cover is provided integrally with the operating panel and that covers the image-scanning portion.

BRIEF DESCRIPTION OF THE DRAWINGS

The above and other objects, features and advantages of the invention will become more apparent from reading the following description of the preferred embodiments taken in connection with the accompanying drawings in which:

FIG. 3(*b*) is a cross-sectional view of the multifunction device shown in FIG. 2 at a condition when the stopper is in a stored or closed state;

FIG. 4(*b*) is a cross-sectional view showing the multifunction device of FIG. 4(*a*) in which the original document discharge tray is in an open state.

DETAILED DESCRIPTION OF THE PREFERRED EMBODIMENT

Figure 1:
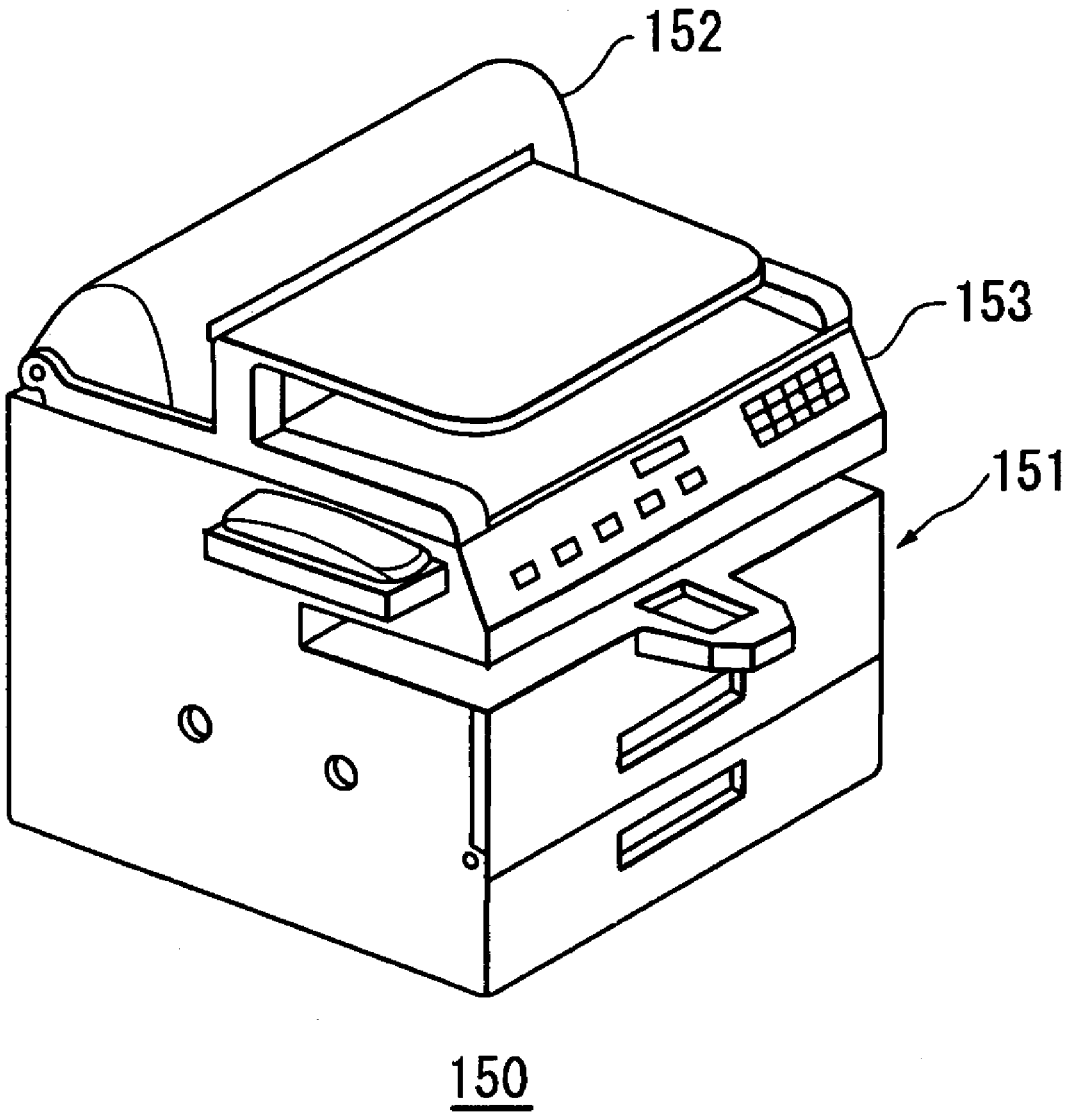
FIG. 1 is a perspective view of a conventional image-forming device.

An image-forming device according to a preferred embodiment of the present invention will be described while referring to the accompanying drawings wherein like parts and components are designated by the same reference numerals to avoid duplicating description.

Figure 2:
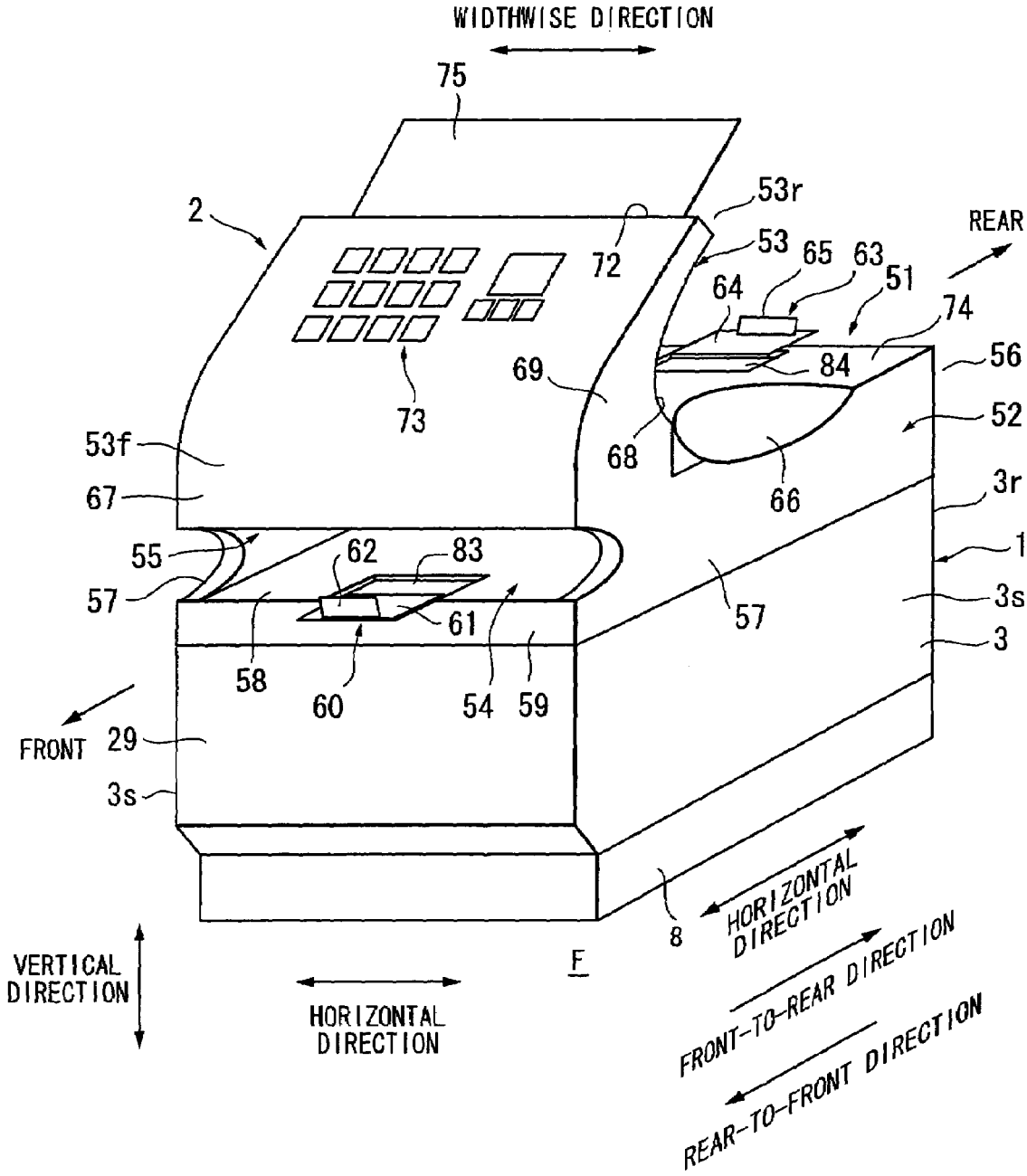
FIG. 2 is a perspective view of a multifunction device according to a preferred embodiment of the present invention.
Figure 3A:
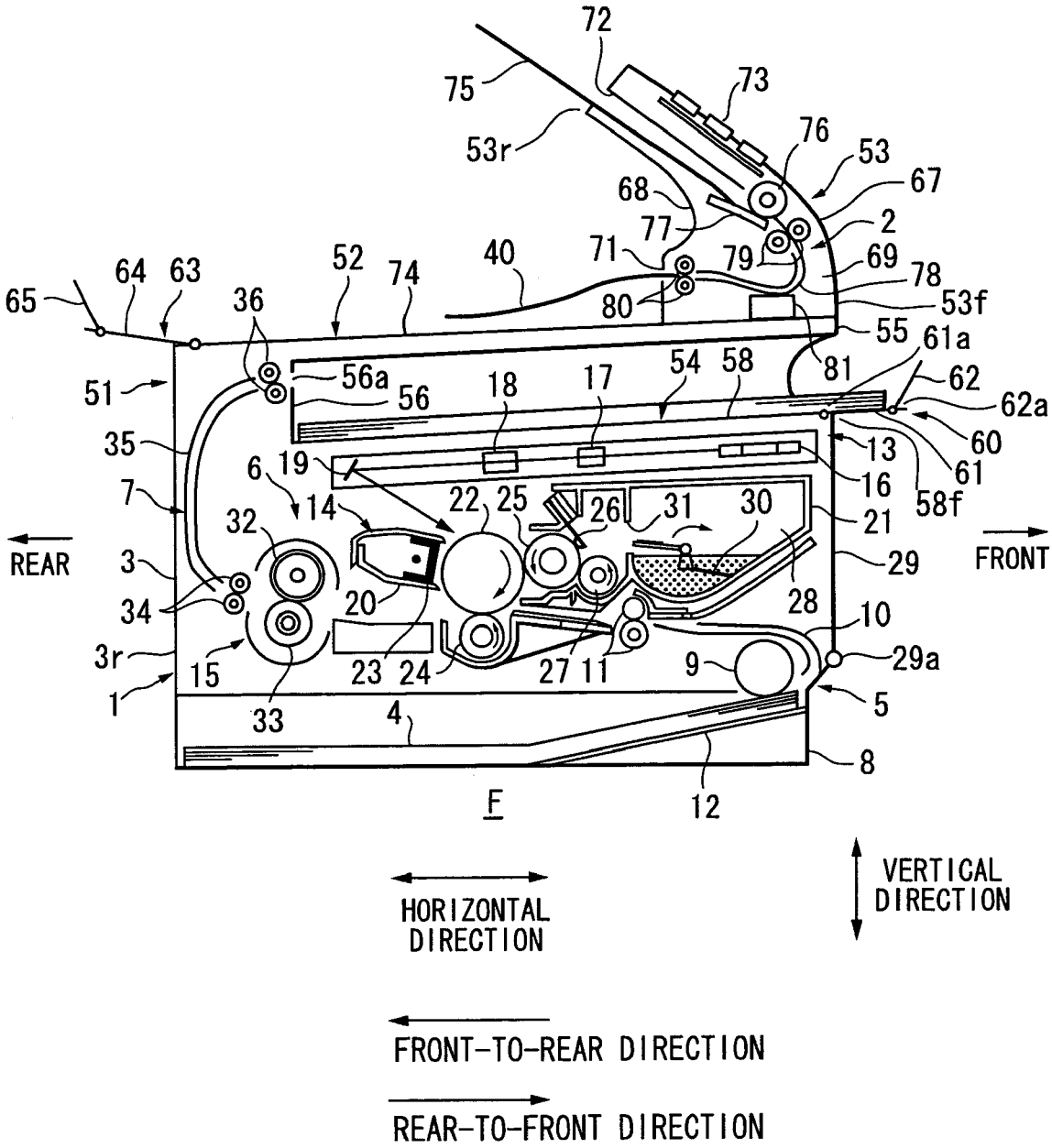
FIG. 3(*a*) is a cross-sectional view of the multifunction device shown in FIG. 2 at a condition when a stopper is in an opened state.
Figure 3B:
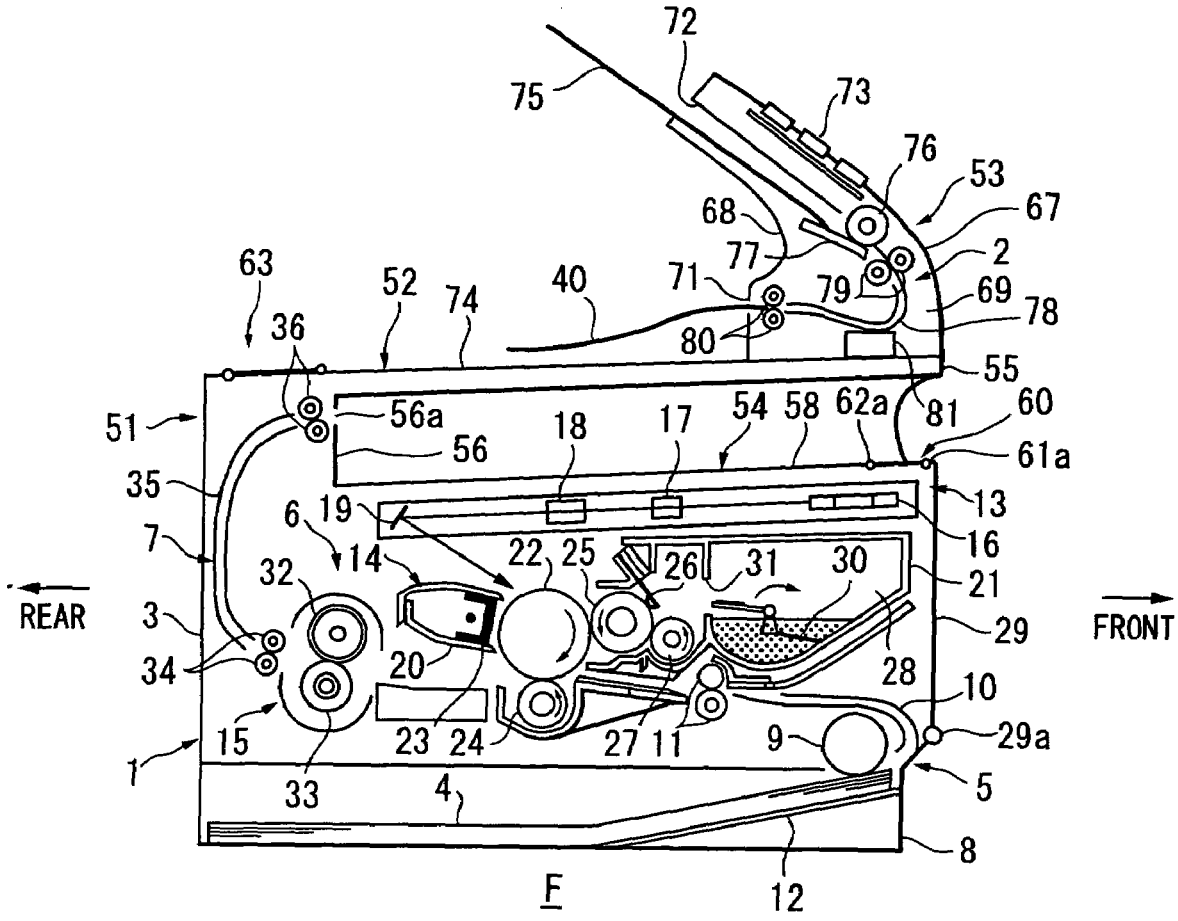

FIG. 2 is a perspective view of a multifunction device F according to the embodiment of the present invention, and FIG. 3(*a*) is a cross-sectional view of the multifunction device F.

In FIG. 2 and FIG. 3(*a*), the multifunction device F includes a printer body 1 and a scanner 2, and has a printing function, a copying function, a facsimile function, and a network communications function.

In the following description, the side of the multifunction device F on which a control panel 73 is provided will be called the front side and the opposite side the rear side.

As shown in FIG. 2, the multifunction device F includes: a main casing 3 formed in a box shape with an open top, and a scanner casing 51 mounted on top of the main casing 3. As shown in FIGS. 2 and 3(*a*), the main casing 3 has a rear wall 3*r*, a pair of side walls 3*a*, and a front cover 29. A front-to-rear direction is defined to extend horizontally from the front side to the rear side of the multifunction device F, that is, from the front cover 29 to the rear wall 3*r*. A rear-to-front direction is defined to extend horizontally from the rear side to the front side of the multifunction device F, that is, from the rear wall 3*r* to the front cover 29. A widthwise direction is defined to extend horizontally and orthogonal or perpendicular to the front-to-back direction as shown in FIG. 2.

In FIG. 3(*a*), the printer body 1 is constructed as an electrophotographic laser printer. The printer body 1 has, inside the main casing 3, a paper feeding section 5, an image forming section 6, and a paper discharging section 7. The paper feeding section 5 is for feeding a sheet of paper 4 as a recording medium to the image forming section 6. The image forming section 6 is for forming images on the supplied sheet of paper 4. The paper discharging section 7 is for discharging the sheet of paper 4 that is formed with images.

The paper feeding section 5 includes a paper cassette 8, a paper supply roller 9, a paper feed path 10, and a pair of registration rollers 11. The paper supply roller 9 is provided above the front end of the paper cassette 8. The paper feed path 10 is for inverting the sheet of paper 4 supplied from the paper cassette 8 and for feeding the paper 4 in the front-to-rear direction, that is, in the direction from the front side to the rear side of the printer body 1. The registration rollers 11 are disposed confronting the paper feed path 10.

The paper cassette 8 is formed in an open-top box-shape and is detachably mounted in the main casing 3 at a location below the image forming section 6. In order to mount the paper cassette 8 into the main casing 3, the paper cassette 8 is inserted into the main casing 3 in a direction from the front side toward the rear side. A paper pressing plate 12 is provided inside the paper cassette 8.

The paper pressing plate 12 is capable of supporting thereon a stack of sheets 4. The paper pressing plate 12 is pivotably supported at its end furthest from the paper supply roller 9 so that the end of the paper pressing plate 12 that is nearest the paper supply roller 9 can move vertically. Although not shown in the drawings, a spring for urging the paper pressing plate 12 upward is provided to the rear surface of the paper pressing plate 12. Therefore, the paper pressing plate 12 pivots downward in accordance with increase in the amount of sheets 4 stacked on the paper pressing plate 12. At this time, the paper pressing plate 12 pivots around the end of the paper pressing plate 12 farthest from the paper supply roller 9, downward against the urging force of the spring.

Urging force of another spring (not shown) provided under the paper pressing plate 12 presses the uppermost sheet 4 on the paper pressing plate 12 toward the paper supply roller 9. As the paper supply roller 9 rotates, one sheet 4 at a time is separated from the stack and supplied to the paper feed path 10, In the paper feed path 10, the sheet of paper 4 is inverted and fed in a direction from the front side to the rear side toward the pair of registration rollers 11. The pair of registration rollers 11 perform a desired registration operation on the supplied sheet 4, and transport the sheet 4 to an image formation position. In the image formation position, a photosensitive drum 22 and a transfer roller 24 contact each other.

The image forming section 6 includes a laser scanning section 13, a process section 14, and a fixing section 15.

The laser scanning section 13 is provided at the upper portion within the casing 3 and is provided with a laser emitting section (not shown), a polygon mirror 16, lenses 17, 18, and a reflection mirror 19. The laser emitting section emits a laser beam based on image data. The polygon mirror 16 is driven to rotate. As indicated by an arrow in FIG. 3(*a*), the laser beam passes through or is reflected by the polygon mirror 16, the lenses 17, 18, and the reflection mirror 19 in this order so as to irradiate, in a high speed scanning operation, the surface of the photosensitive drum 22 of the process section 14.

The process section 14 is disposed below the laser scanning section 13. The process section 14 includes a drum cartridge 20. The drum cartridge 20 is detachaly mounted in the main casing 3 and is provided with a development cartridge 21, the photosensitive drum 22, and a scorotron charge unit 23. The process section 14 also includes a transfer roller 24, which is fixedly secured to the main casing 3 and which is pressed against the photosensitive drum 22 when the drum cartridge 20 is mounted in the main casing 3.

The development cartridge 21 is detachably mounted to the drum cartridge 20, and is provided with a developing roller 25, a layer thickness regulating blade 26, a supply roller 27, and a toner hopper 28.

The front cover 29 defines the front surface of main casing 3. When the front cover 29 is opened to form an opening on the front side of the main casing 3, the development cartridge 21 and the drum cartridge 20, which are integrated together, can be mounted into and detached from the main casing 3 via the opening formed in the front side of the main casing 3.

The front cover 29 is rotatably supported on the main casing 3 by a hinge 29*a* provided on the bottom edge of the front cover 29. The front cover 29 is opened and closed in relation to the main casing 3 by swinging the top edge of the front cover 29 forward and rearward. When the front cover 29 is opened, the drum cartridge 20 is inserted into the main casing 3 via the opened front surface thereof in the direction from the front side to the rear side, and is mounted in the main casing 3.

The toner hopper 28 is filled with positively charging, non-magnetic, single-component toner. In the present embodiment, polymerization toner is used as the toner. Polymerization toner has substantially spherical particles and so has an excellent fluidity characteristic. To produce polymerization toner, a polymerizing monomer is subjected to well-known copolymerizing processes, such as suspension polymerization. Examples of a polymerizing monomer include a styrene type monomer and an acrylic type monomer. An example of a styrene type monomer is styrene.

Examples of acrylic type monomers are acrylic acid, alkyl (C1–C4) acrylate, and alkyl (C1–C4) metaacrylate. Because the polymerization toner has such an excellent fluidity characteristic, image development is reliably performed so that high-quality images can be formed.

Materials such as wax and a coloring agent are distributed in the toner. The coloring agent can be carbon black, for example. In addition, external additive, such as silica, are added in the toner to further improve the fluidity characteristic. The toner has a particle diameter of about 6–10 μm.

A rotation shaft is disposed in the center of the toner hopper 28. An agitator 30 is supported on the rotation shaft. The agitator 30 rotates in the clockwise direction as indicted by an arrow. The agitator 30 agitates the toner in the toner hopper 28 and discharges the toner through a toner supply opening 31 that is opened through the side wall of the toner hopper 28.

The supply roller 27 is located to the side of the toner supply opening 31. The developing roller 25 is located confronting the supply roller 27. The supply roller 27 and the developing roller 25 are rotatable in the counterclockwise direction. The supply roller 27 and the developing roller 25 are disposed in abutment contact with each other so that both are compressed to a certain extent.

The supply roller 27 includes a metal roller shaft covered with a roller formed from an electrically conductive sponge material. The supply roller 27 rotates in the counterclockwise direction as indicated by an arrow.

The developer roller 25 includes a metal roller shaft and a roller portion covered thereon. The roller portion is made from a resilient member formed from a conductive rubber material. In more specific terms, the roller portion of the developing roller 25 is made from conductive silicone rubber or urethane rubber including, for example, carbon particles. The surface of the roller portion is covered with a coating layer of silicone rubber or urethane rubber that contains fluorine. The developing roller 25 is applied with a developing bias with respect to the photosensitive drum 22. The developing roller 25 rotates in the counterclockwise direction as indicted by an arrow.

The layer thickness regulating blade 26 is disposed near the developing roller 25. The layer thickness regulating blade 26 includes a blade made from a metal leaf spring, and has a pressing member, that is provided on a free end of the blade. The pressing member has a semi-circular shape when viewed in cross section. The pressing member is formed from silicone rubber with electrically insulating properties. The layer thickness regulating blade 26 is supported by the developing cartridge 28 at a location near the developing roller 25. The resilient force of the blade presses the pressing member against the surface of the developing roller 25.

The rotation of the supply roller 27 supplies the developing roller 25 with toner that has been discharged through the toner supply opening 31. At this time, the toner is triboelectrically charged to a positive charge between the supply roller 27 and the developing roller 25. Then, as the developing roller 25 rotates, the toner supplied onto the developing roller 25 moves between the developing roller 25 and the pressing member of the layer thickness regulating blade 26. This reduces thickness of the toner on the surface of the developing roller 25 down to a thin layer of uniform thickness.

The photosensitive drum 22 is disposed to the side of and in confrontation with the developing roller 25. The photosensitive drum 22 is rotatable in the clockwise direction as indicated by an arrow in the drum cartridge 20. The photosensitive drum 22 includes a drum-shaped member and a surface layer. The drum-shaped member is connected to ground. The surface layer is formed on the drum-shaped member from a photosensitive layer that is made from polycarbonate and that has a positively charging nature.

The scorotoron charge unit 23 is disposed to the side of the photosensitive drum 22 and is spaced away from the photosensitive drum 22 by a predetermined space so as to avoid direct contact with the photosensitive drum 22. The scorotron charge unit 23 is a positive-charge scorotron type charge unit for generating a corona discharge from a charge wire made from, for example, tungsten. The scorotoron charge unit 23 forms a blanket of positive-polarity charge on the surface of the photosensitive drum 22.

The transfer roller 24 is rotatably supported in the main casing 3 at a position below and in confrontation with the photosensitive drum 22. The transfer roller 24 is rotatable in the counterclockwise direction as indicated by an arrow. The transfer roller 24 includes a metal roller shaft and a roller portion covering the shaft and made from electrically-conductive rubber material. At times of toner image transfer, the transfer roller 24 is applied with a transfer bias with respect to the photosensitive drum 22.

As the photosensitive drum 22 rotates, the scorotoron charge unit 23 first forms a blanket of positive charge on the surface of the photosensitive drum 22, and then the surface of the photosensitive drum 22 is exposed to high speed scan of the laser beam from the laser scanning section 13. The electric potential of the positively charged surface of the photosensitive drum 22 drops at positions exposed to the laser beam. As a result, an electrostatic latent image is formed on the photosensitive drum 22 based on image data used to drive the laser beam. Next, an inverse developing process is performed. That is, as the developing roller 25 rotates, the positively-charged toner borne on the surface of the developing roller 25 is brought into contact with the photosensitive drum 22. The toner on the developing roller 25 is supplied to lower-potential areas of the electrostatic latent image on the photosensitive drum 22. As a result, the toner is selectively borne on the photosensitive drum 22 so that the electrostatic latent image is developed into a visible toner image.

Thereafter, the visible toner image borne on the surface of the photosensitive drum 22 is transferred to a sheet 4 according to the transfer bias applied to the transfer roller 24 as the sheet 4, which is being conveyed from the front to the rear by the registration rollers 11, passes between the photosensitive drum 22 and the transfer roller 24.

The fixing section 15 is disposed to the side of the process section 14 and downstream of the same in the conveying direction of the paper 4. The fixing section 15 includes a heating roller 32, a pressure roller 33 applying pressure to the heating roller 32, and a pair of conveying rollers 34. The conveying rollers 34 are disposed downstream of the heating roller 32 and the pressure roller 33.

The heating roller 32 is formed of metal in a cylindrical shape and accommodates a fixing heater including a halogen lamp. The fixing heater heats the heating roller 32.

The pressure roller 33 presses against the heating roller 32 and rotates following the heating roller 32.

In this way, the process section 14 transfers toner onto the paper 4. The heating roller 32 and pressure roller 33 subsequently fix the toner onto the paper 4 by heat as the paper 4 passes therebetween. The conveying rollers 34 convey the paper 4 onto a paper discharge path 35 in the sheet discharging section 7.

The paper discharging section 7 includes the paper discharge path 35, and a pair of discharge rollers 36.

The paper discharge path 35 extends vertically from the conveying rollers 34 to the discharge rollers 36 disposed above the conveying rollers 34.

The pair of discharge rollers 36 is disposed above the main casing 3 within a discharge opening cover 56 provided in the scanner casing 51.

After undergoing a printing operation, the paper 4 is conveyed from the conveying rollers 34 along the paper discharge path 35, where the paper 4 is once again inverted, and the discharge rollers 36 discharge the paper 4 from the rear of the device F toward the front through a paper discharge through-hole 56*a* formed in the discharge opening cover 56. The paper 4 is discharged onto a paper discharge tray 58 provided in the scanner casing 51 with the surface having the formed image face down.

As shown in FIG. 2, the scanner casing 51 includes: a paper discharge cover 52 and a scanner cover 53, which are formed integrally with each other. As shown in FIGS. 2 and 3(*a*), the scanner cover 53 has a front end 53*f* and a rear end 53*r* along the front-to-rear direction.

As shown in FIG. 3(*a*), the paper discharge cover 52 includes: a lower cover 54; an upper cover 55; the discharge opening cover 56; and a pair of side covers 57 (see FIG. 2), which are formed integrally with one another. The discharge opening cover 56 is substantially box-shaped and facilitates discharging of the paper 4. The pair of side covers 57 are disposed on opposite sides of the paper 4 that is discharged from the discharge opening cover 56.

More specifically, the discharge opening cover 56 is provided on the upper rear section of the main casing 3. The discharge opening cover 56 is of a substantially rectangular frame shape. The discharge opening cover 56 extends over the entire width of the main casing 3. As shown in FIG. 3(*a*), the rear wall of the discharge opening cover 56 is in vertical alignment with the rear wall 3*r* of the main casing 3. The pair of side walls of the discharge opening cover 56 are in vertical alignment with the pair of side walls 3*s* of the main casing 3. The bottom of the discharge opening cover 56 opens into the main casing 3, enabling the discharge rollers 36 to be accommodated in the discharge opening cover 56. The paper discharge through-hole 56*a* is formed in the front wall of the discharge opening cover 56 at a location opposing the discharge rollers 36 to allow discharging of the paper 4.

The lower cover 54 is integrally formed with the discharge opening cover 56. The lower cover 54 extends from the front bottom end of the discharge opening cover 56. That is, the lower cover 54 extends in the rear-to-front direction, with the rear end of the lower cover 54 being connected to the front wall of the discharge opening cover 56 and the front end of the lower cover 54 being in vertical alignment with the front end of the main casing 3 (front cover 29). As shown in FIG. 2, the top surface of the lower cover 54 is flat and serves as the paper discharge tray 58 for receiving the paper 4 thereon. The peripheral edges of the paper discharge tray 58 are curved downward and form a base 59 for mounting the paper discharge tray 58 onto the main casing 3.

A stopper 60 is provided on the front end of the paper discharge tray 58 for stopping the discharged paper 4. Specifically, a depression 83 substantially rectangular in shape in a plan view is formed approximately in the widthwise center of the paper discharge tray 58. The stopper 60 is embedded in the depression 83. As shown in FIG. 3(*a*), the stopper 60 includes a paper-receiving plate 61 that is substantially rectangular in shape and functions to receive the paper 4, and a paper stopping plate 62 that is substantially rectangular in shape and functions to prevent the paper 4 from protruding from the front side of the printer body 1. The paper-receiving plate 61 rotatably supported on the paper discharge tray 58 by a hinge 61*a* disposed in the front end of the depression 83. The paper stopping plate 62 is rotatably supported on the paper-receiving plate 61 (rotation is restricted when the paper stopping plate 62 reaches an erect position on the paper-receiving plate 61) by a hinge 62*a* disposed in the paper-receiving plate 61 on a side opposite the end that the paper-receiving plate 61 is rotatably supported on the paper discharge tray 58.

With this construction, the stopper 60 can be switched between a closed (stored) state and an opened state. In the closed state shown in FIG. 3(*b*), the paper-receiving plate 61 and paper stopping plate 62 are folded together and accommodated in the depression 83 formed in the paper discharge tray 58. The opened state shown in FIG. 3(*a*) is achieved from the closed state by rotating the paper-receiving plate 61 about the hinge 61*a* until substantially horizontal on the front end of the paper discharge tray 58 and subsequently rotating the paper stopping plate 62 about the hinge 62*a* toward the front of the printer body 1 until erected on the front end of the paper-receiving plate 61.

When the stopper 60 is in this opened state, the paper-receiving plate 61 protrudes farther forward than the front end 58*f* of the paper discharge tray 58. Therefore, the paper-receiving plate 61 protrudes farther forward than the front end 53*f* of the scanner cover 53. The paper stopping plate 62 is erected on the front end of the paper-receiving plate 61.

When the stopper 60 is opened during an operation to discharge the paper 4, the paper 4 discharged by the discharge rollers 36 is received on the paper discharge tray 58, with the leading edge of the paper 4 being received on the paper-receiving plate 61. Accordingly, sheets of the discharged paper 4 are stacked on the paper discharge tray 58 with the leading edges of the papers 4 positioned farther forward than the front end 53*f* of the scanner cover 53 and the trailing edges of the papers 4 positioned farther rearward than the rear end 53*r* of the scanner cover 53.

The upper cover 55 is formed integrally with the discharge opening cover 56 and is located on the top of the discharge opening cover 56. The upper cover 55 is formed in a plate shape extending in the rear-to-front direction. The rear end of the upper cover 55 is in vertical alignment with the rear wall of the discharge opening cover 56, while the front end of the upper cover 55 is located at a position opposite the front end of the lower cover 54. Hence, the upper cover 55 is disposed over the lower cover 54 and is parallel to the same, but is separated vertically a prescribed distance therefrom.

The scanner cover 53 is disposed on the front end of the upper cover 55. More specifically, if the printer body 1 were projected onto the installation space and this projected area were divided into a front area and a rear area in the front-to-back direction, the scanner cover 53 would be projected in the front area. The top surface of the upper cover 55 behind the scanner cover 53 serves as an original document discharge tray 74.

A stopper 63 is disposed on the rear end of the original document discharge tray 74 for stopping an original document 40 when the document is discharged. Specifically, a depression 84 (see FIG. 2) having a substantially rectangular shape in a plan view is formed in the approximate widthwise center of the original document discharge tray 74, and the stopper 63 is embedded in the depression 84. The stopper 63 includes a document receiving plate 64 that is substantially rectangular in shape and functions to receive the original document 40, and a document stopping plate 65 that is also substantially rectangular in shape and functions to prevent the original document 40 from protruding from the rear end of the printer body 1. The document receiving plate 64 is rotatably supported on the original document discharge tray 74 about a hinge disposed in the rear end of the depression 84. Further, the document stopping plate 65 is rotatably supported on the document receiving plate 64 (rotation is restricted when the document stopping plate 65 reaches an erect position on the document receiving plate 64) about a hinge disposed on one end of the document receiving plate 64 opposite the end where the document receiving plate 64 is rotatably supported on the original document discharge tray 74.

With this construction, the stopper 63 can be switched between a closed (stored) state and an opened state. In the closed state shown in FIG. 3(*b*), the document receiving plate 64 and document stopping plate 65 are folded over one another and accommodated in the depression 84 of the original document discharge tray 74. The opened state shown in FIG. 3(*a*) is achieved from the closed state by rotating the document receiving plate 64 rearward about the hinge until substantially horizontal and subsequently rotating the document stopping plate 65 rearward about the hinge until erected on the rear end of the original document discharge tray 74.

When the stopper 63 is in this opened state, the document receiving plate 64 protrudes farther rearward than the rear end of the original document discharge tray 74, and the document stopping plate 65 is erected on the rear end of the document receiving plate 64.

As shown in FIG. 2, the side covers 57 are-separated a prescribed distance from each other and joined to both widthwise ends of the lower cover 54 and upper cover 55. The side covers 57 are integrally formed with the discharge opening cover 56. The side covers 57 extend from the front ends of the pair of side walls in the discharge opening cover 56. The front end of each side cover 57 is curved inward toward the rear of the printer body 1 to facilitate removal of the paper 4.

As also shown in FIG. 2, a depression 66 is formed in one widthwise side of the original document discharge tray 74, enabling the user to grip the discharged original document 40.

The depression 66 is formed in one widthwise end (normally the side corresponding to the dominant hand) of the original document discharge tray 74 as if the seamless corner between the original document discharge tray 74 and the side cover 57 has been cut out. The depression 66 grows gradually wider and deeper from a point midway on the original document discharge tray 74 in the widthwise direction toward the widthwise end of the original document discharge tray 74.

As shown in FIG. 3(*a*), the scanner cover 53 is disposed on the front end of the original document discharge tray 74. The scanner cover 53 includes: a front cover 67, a rear cover 68, and a pair of side covers 69, which are formed integrally with one another.

The front cover 67 extends upward from the front end of the upper cover 55, beginning in a substantially vertical direction and subsequently curving toward the rear of the printer body 1 and continuing in a slant upward and rearward. In this example, the front end of a part of the front cover 67 that extends upward from the front end of the upper cover 55 serves as the front end 53*f* of the scanner cover 53.

The rear cover 68 extends first vertically upward from the front end of the original document discharge tray 74, curves in an arc toward the front of the printer body 1 and subsequently curves back in a slanted direction upward and rearward and extends parallel to the front cover 67. A document discharge through-hole 71 is formed to extend in the widthwise direction in the bottom part of the rear cover 68, which extends vertically upward, to facilitate discharging of the original document 40.

As shown in FIG. 2, the side covers 69 are integrally provided on both widthwise ends of the front cover 67 and rear cover 68.

A slot is formed in the top end of the scanner cover 53 above the document discharge through-hole 71 that is bordered by the top ends of the front cover 67, rear cover 68, and side covers 69. This slot is a document feeding through-hole 72 for supplying the original document 40. In this example, the top end of the scanner cover 53 (that is, the top ends of the front cover 67, rear cover 68, and side covers 69) serves as the rear end 53*r* of the scanner cover 53.

The scanner cover 53 is also provided with: the control panel 73 that enables the user to perform operations; the scanner 2; and a document feeding tray 75.

As shown in FIG. 2, the control panel 73 is integrally provided with the front cover 67, which extends at a slant upward and rearward. The control panel 73 includes an array of various buttons, a liquid crystal display, and the like for operating the multifunction device F, that is, the printer body 1 and the scanner 2.

The scanner 2 is an ADF device disposed in the scanner cover 53 for automatically scanning the original document 40. The scanner 2 includes a feeding roller 76, a separating pad 77, a document conveying path 78, a pair of first conveying rollers 79, a pair of second conveying rollers 80, and a CCD sensor 81.

The feeding roller 76 and separating pad 77 are disposed inside the scanner cover 53. More specifically, the feeding roller 76 and separating pad 77 are disposed in the front section in the scanner cover 53. The feeding roller 76 and separating pad 77 are disposed in confrontation with each other. The document conveying path 78 is a substantially U-shaped path extending from the feeding roller 76 to the document discharge through-hole 71 that begins in a slanted direction downward and toward the front and subsequently curves toward the rear. The pair of first conveying rollers 79 is provided on the upstream end of this document conveying path 78 in the direction in which the document is conveyed, while the pair of second conveying rollers 80 is disposed on the downstream end of the document conveying path 78. The CCD sensor 81 is disposed between the pair of first conveying rollers 79 and the pair of second conveying rollers 80. Both the first conveying rollers 79 and the second conveying rollers 80 are configured of a pair of rollers between which the original document 40 is interposed and conveyed.

The document feeding tray 75 extends from the rear side of the separating pad 77 at a slant that is upward and toward the rear, and protrudes from the document feeding through-hole 72 in the same direction.

To scan the original document 40, the user inserts the original document 40 into the document feeding through-hole 72 provided on the rear side of the scanner 2 and, with the original document 40 resting on the document feeding tray 75, operates the control panel 73 to indicate a desire to begin a document scan. When the user performs this operation, the original document 40 resting on the document feeding tray 75 becomes interposed between the feeding roller 76 and the separating pad 77 and is fed to the first conveying rollers 79 one sheet at a time. The first conveying rollers 79 convey the original document 40 diagonally downward and forward, and the original document 40 follows the document conveying path 78, which curves back toward the rear of the printer body 1, causing the original document 40 to flip over. When the original document 40 moves across the CCD sensor 81, the CCD sensor 81 reads the image formed on the original document 40. Subsequently, the second conveying rollers 80 convey the original document 40 rearward through the document discharge through-hole 71 formed in the rear side of the scanner 2 and discharge the original document 40 onto the original document discharge tray 74.

The multifunction device F can form an image on the paper 4 in the image forming section 6 based on the data read by the CCD sensor 81.

In the multifunction device F of the preferred embodiment, both the scanner 2 and the control panel 73 are disposed on the front side of the printer body 1. The control panel 73 is integrally provided on the front cover 67 of the scanner cover 53, which covers the scanner 2. This arrangement allows for a compact device that conserves installation area. Further, operability can also be improved by allowing the user to handle the original document 40 when the original document 40 is fed into or discharged from the scanner 2 and to operate the control panel 73 in the same vicinity.

When projecting the printer body 1 onto the installation space, the scanner cover 53, which is provided with the scanner 2 and the control panel 73, falls in the front portion of the projected area. The document feeding tray 75 provided on the rear side of the scanner 2 extends diagonally upward and rearward. When projecting the printer body 1 onto the installation space, the document feeding tray 75 falls within the projected area. The document feeding tray 75 does not protrude farther rearward than the printer body 1, thereby preventing the document feeding tray 75 from hindering traffic around the printer body 1 and preventing people from catching their clothing or the like on the document feeding tray 75 and from accidentally knocking over the original documents 40.

When the pair of discharge rollers 36 discharges the paper 4 in the multifunction device F according to the preferred embodiment, the paper 4 becomes stacked on the paper discharge tray 58 with the leading edge of the paper 4 positioned farther forward than the front end 53*f* of the scanner cover 53. As a result, the user can remove the discharged paper 4 without being impeded by the scanner cover 53. Further, the discharged paper 4 is stacked on the paper discharge tray 58 such that the trailing edge of the paper 4 is positioned farther rearward than the rear end 53*r* of the scanner cover 53. Accordingly, the discharged paper 4 does not protrude farther than necessary from the front end 53*f* of the scanner cover 53, thereby preventing passersby from accidentally knocking over the paper 4.

Further, in the image forming section 6 of the printer body 1, a toner image carried on the surface of the photosensitive drum 22 is transferred onto the paper 4 as the registration rollers 11 convey the paper 4 rearward. Therefore, after the fixing process, the paper 4 can be inverted in the paper discharge path 35 and discharged by the discharge rollers 36 from the rear toward the front. Hence, space can be conserved since it is only necessary to provide the paper discharge path 35 for inverting the paper 4. By inverting the paper 4, the space in which the paper 4 is discharged can be kept within the projected area of the printer body 1 on the installation space, thereby reducing the required area for installation. In this way, the paper 4 is discharged such that the surface on which an image has been formed is face down, enabling the sheets of the paper 4 to be arranged in the printing order from bottom to top on the paper discharge tray 58.

Moreover, in the multifunction device F according to the preferred embodiment, the paper cassette 8 is provided below the image forming section 6 in the printer body 1, enabling the installation area to be further reduced.

With the multifunction device F of the preferred embodiment, the original document 40 is supplied to the document feeding through-hole 72 in the direction from rear to front. The original document 40 is subsequently inverted, scanned by the scanner 2, and discharged through the document discharge through-hole 71 from the front toward the rear. Hence, the original document 40 can be scanned without protruding off the side of the printer body 1, thereby preventing passersby from knocking over the original document 40.

By providing the depression 66 in the original document discharge tray 74 of the multifunction device F described above, the user can easily get a grip on both top and bottom surfaces of the original document 40 discharged onto the original document discharge tray 74 in the depression 66 in order to remove the original document 40 from the original document discharge tray 74. By facilitating removal of the original document 40 in this way, operability can be improved.

In the multifunction device F of the preferred embodiment, the development cartridge 21 and drum cartridge 20, which are integrated together, are inserted into and removed from the front side of the multifunction device F. Thus, insertion and removal of the development cartridge 21 and drum cartridge 20 are executed on the same side used to access the control panel 73, thereby improving operability.

In the multifunction device F shown in FIG. 3(*a*), the document feeding tray 75, original document discharge tray 74, paper discharge tray 58, and paper cassette 8 are arranged in a vertical alignment. Since these components do not protrude greatly from the area of the printer body 1 projected on the installation space, it is possible to produce a compact device with a small installation space, even when providing the printer body 1 with the scanner 2.

In the printer body 1 described above, the image forming section 6 is disposed below the paper discharge tray 58 and the paper cassette 8 is disposed below the image forming section 6, making it possible to produce a compact printer body 1 with a reduced footprint.

In the multifunction device F of the preferred embodiment, the conveying direction of the original document 40 in the scanner 2, the conveying direction of the paper 4 in the image forming section 6, the mounting direction of the paper cassette 8, and the mounting direction of the drum cartridge 20 are all substantially the same front-to-back direction. Accordingly, the user can access each of the original document 40, paper 4, and paper cassette 8 in the same front-to-back direction, thereby improving operability.

In the multifunction device F of the preferred embodiment, the scanner 2 is disposed on the front side of the printer body 1, the document feeding tray 75 on the rear side of the scanner 2, and the original document discharge tray 74 below the document feeding tray 75. Since the original document 40 supplied from the document feeding tray 75 is scanned, inverted, and discharged onto the original document discharge tray 74, the original document 40 can be scanned without protruding off the printer body 1. This construction can prevent passersby from accidentally knocking over the original document 40.

In the multifunction device F of the preferred embodiment, the paper discharge tray 58 is disposed below the original document discharge tray 74, enabling the user to easily access both the original document 40 and the paper 4 and, hence, further improving operability.

<Modification>

Figure 4A:
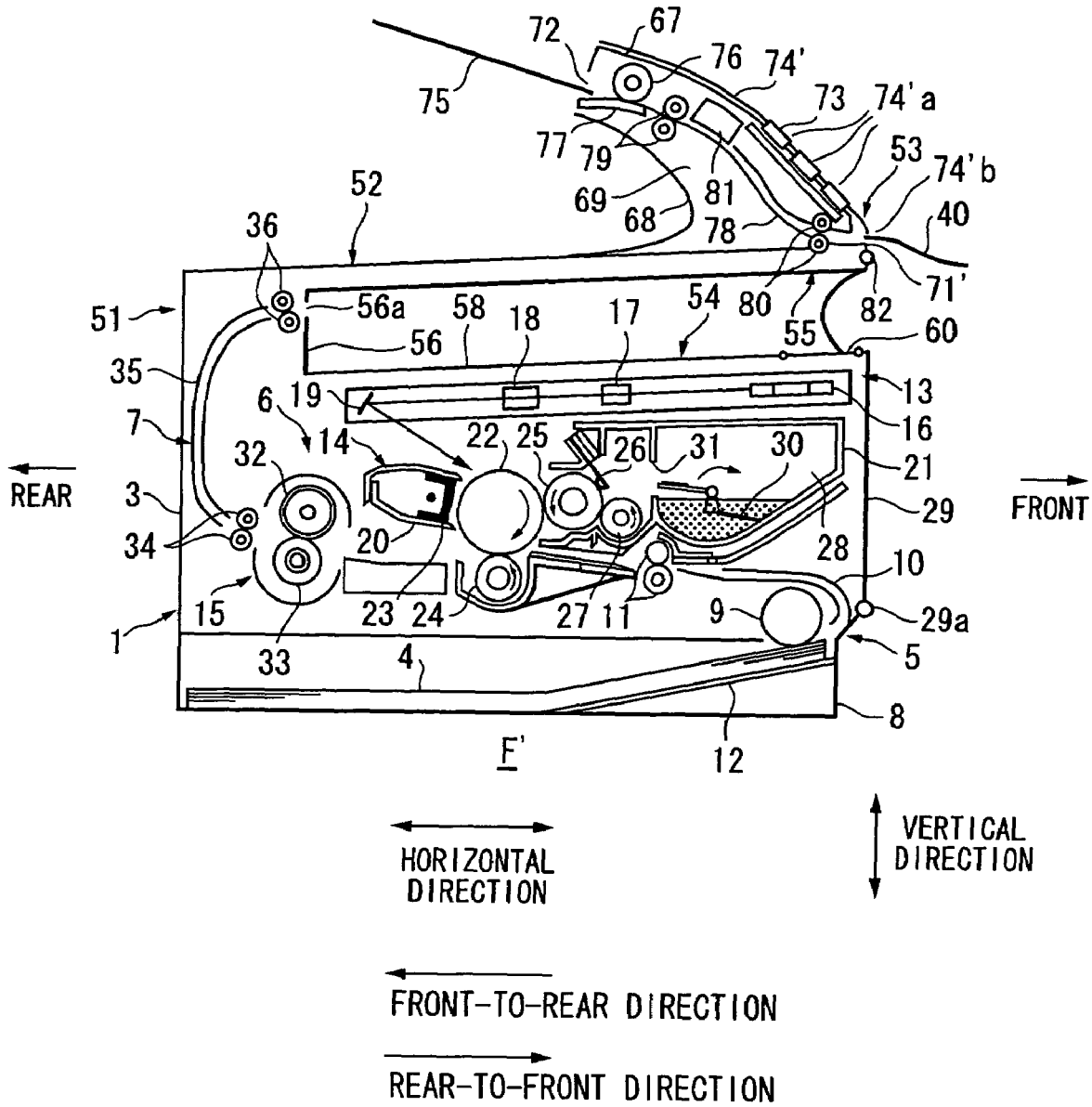
FIG. 4(*a*) is a cross-sectional view of a multifunction device according to a modification in which an original document discharge tray is in a closed state.
Figure 4B:
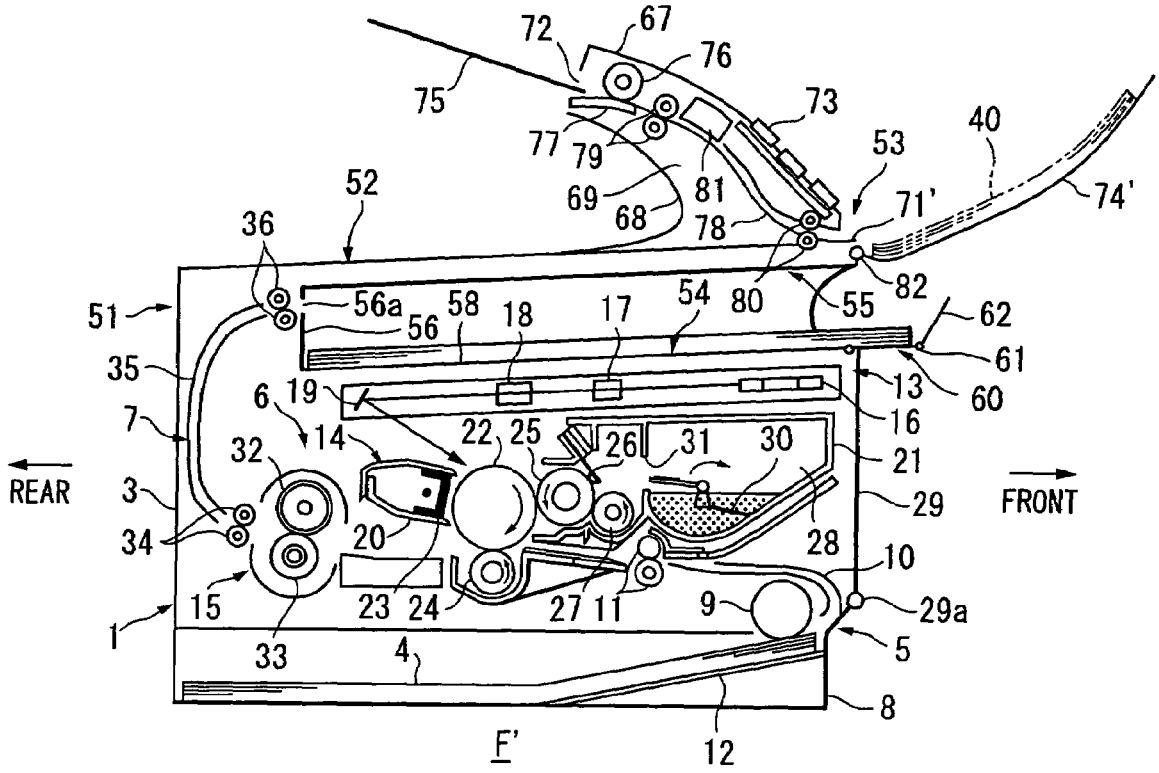

In the multifunction device F of the preferred embodiment described above, the document discharge through-hole 71 is provided on the bottom rear side of the scanner 2. According to a multifunction device F' of the present modification, a document discharge through-hole 71' is provided on the bottom front side of the scanner 2 as shown in FIG. 4(*a*) and FIG. 4(*b*). Parts and components in the multifunction device F' of the present modification that are similar to those in the multifunction device F of the above-described embodiment are designated with the same reference numerals to avoid duplicating description. Excluding the following description, the remaining construction of the multifunction device F' is similar to that of the multifunction device F shown in FIGS. 2 through 3(*b*) and, hence, a description of the remaining construction is omitted.

In the multifunction device F', as shown in FIG. 4(*a*) and FIG. 4(*b*), the printer body 1 has the same construction as in the multifunction device F of FIGS. 2 through 3(*b*). However, the top surface of the upper cover 55 is not used as an original document discharge tray in the multifunction device F'. Instead, an additional original document discharge tray 74' is added to the scanner cover 53 in the multifunction device F'.

The front cover 67 in the scanner cover 53 is formed in a curve extending diagonally upward and rearward. A document discharge through-hole 71' is formed widthwise in the bottom section of the front cover 67 for discharging the original document 40.

The rear cover 68 in the scanner cover 53 is formed in an approximate U shape that extends from a point midway on the upper cover 55 in the front-to-rear direction, initially traveling forward and upward before curving backward to a direction upward and rearward and extending parallel to the front cover 67.

The side covers 69 in the scanner cover 53 are joined to the widthwise ends of the front cover 67 and rear cover 68.

The document feeding through-hole 72 is formed in the top end of the scanner cover 53 bordered by the top ends of the front cover 67, rear cover 68, and side covers 69. The document feeding through-hole 72 is positioned diagonally above and behind the document discharge through-hole 71'.

The feeding roller 76 and separating pad 77 are disposed in confrontation with each other in the upper rear end of the scanner cover 53. The document conveying path 78 extends from the feeding roller 76 to the document discharge through-hole 71' in a slanted direction downward and toward the front. The first conveying rollers 79 are provided on the upstream end of this document conveying path 78 in the direction in which the document is conveyed, while the second conveying rollers 80 are disposed on the downstream end of the document conveying path 78. The CCD sensor 81 is disposed between the pair of first conveying rollers 79 and the pair of second conveying rollers 80. Both the first conveying rollers 79 and the second conveying rollers 80 are configured of a pair of rollers between which the original document 40 is interposed and conveyed.

The original document discharge tray 74' covers the front cover 67, and the bottom end of the original document discharge tray 74' is capable of rotating about a hinge 82 disposed on the front end of the upper cover 55. A plurality of first openings 74'*a* are formed in the original document discharge tray 74' at positions corresponding to the plurality of buttons and the like on the control panel 73. A second opening 74'*b* is formed in the original document discharge tray 74' at a position corresponding to the document discharge through-hole 71'. It is noted that the plurality of first openings 74'*a* may be formed as a single large opening revealing the entire control panel 73, the single large opening being provided with wires or the like in a mesh construction. The first and second openings 74'*a* and 74'*b* may be combined into a single opening revealing the entire control panel 73 and may be filled with wires or the like in a mesh construction.

Hence, when the original document discharge tray 74' is closed over the front cover 67, as shown in FIG. 4(*a*), the control panel 73 can still be operated through the first openings 74'*a*, and the original document 40 can be discharged through the second opening 74'*b*. By swinging the original document discharge tray 74' open about the hinge 82, as shown in FIG. 4(*b*), the original document discharge tray 74' is maintained in a position extending at a diagonal upward and forward, enabling the original document 40 discharged from the document discharge through-hole 71' to be received in a stack on the original document discharge tray 74'.

The original document discharge tray 74' is detachably mounted on the hinge 82. When receiving an impact, the original document discharge tray 74' readily disengages from the hinge 82 and separates from the front cover 67.

To scan the original document 40, the user inserts the original document 40 into the document feeding through-hole 72 provided on the rear side of the scanner 2 and, with the original document 40 resting on the document feeding tray 75, operates the control panel 73 to indicate a desire to begin a document scan. When the user performs this operation, the original document 40 resting on the document feeding tray 75 becomes interposed between the feeding roller 76 and the separating pad 77 and is fed to the first conveying rollers 79 one sheet at a time. The first conveying rollers 79 convey the original document 40 diagonally downward and forward. When the original document 40 moves across the CCD sensor 81, the CCD sensor 81 reads the image formed on the original document 40. Subsequently, the second conveying rollers 80 discharge the original document 40 in the rear-to-front direction through the document discharge through-hole 71' provided on the front of the scanner 2. The original document 40 can be received in a stack on the original document discharge tray 74' when the original document discharge tray 74' is in an open state. However, when the original document discharge tray 74' is closed, the user must receive the original document 40 manually one sheet at a time. Normally, the original document discharge tray 74' is kept in the closed position only when there are few sheets of the original document.

In the multifunction device F' shown in FIG. 4(*a*) and FIG. 4(*b*), the original document 40 received on the document feeding tray 75 is supplied to the document feeding through-hole 72 in the rear-to-front direction. After being scanned by the scanner 2, the original document 40 is discharged through the document discharge through-hole 71' in the same rear-to-front direction. Therefore, the original document 40 can be scanned and discharged along a substantially straight path and can be removed from the same side used to access the control panel 73, thereby facilitating removal of the original document 40 and, hence, improving operability.

With this multifunction device F', by closing the original document discharge tray 74' when there is no need to receive, on the original document discharge tray 74', the original document 40 discharged via the document discharge through-hole 71' (for example, when the original document 40 includes only one sheet that can be removed without being stacked), the original document discharge tray 74' does not project from the side of the printer body 1, thereby preventing a passerby from knocking over the original document discharge tray 74'. Moreover, even when the original document discharge tray 74' is closed, the control panel 73 can be operated, and the original document 40 can be discharged in a forward direction via the document discharge through-hole 71' without being jammed.

On the other hand, by opening the original document discharge tray 74' when it is necessary to receive, on the original document discharge tray 74', the original document 40 discharged via the document discharge through-hole 71' (for example, when a plurality of sheets of the original document 40 are being scanned and must be stacked), the original document 40 discharged from the scanner 2 via the document discharge through-hole 71' can be received and stacked on the original document discharge tray 74'. Hence, operability is improved and the original document 40 discharged from the scanner 2 can be received in a stack.

Further, since the original document discharge tray 74' is designed to separate from the front cover 67 upon receiving an impact, damage to the scanner cover 53 and the printer body 1 can be avoided.

While the invention has been described in detail with reference to the specific embodiment thereof, it would be apparent to those skilled in the art that various changes and modifications may be made therein without departing from the spirit of the invention.

What is claimed is:

1. An image-forming device, comprising:

an image-forming unit that includes an image-forming portion that forms an image on a recording medium, the image-forming unit being projected down onto an area in which the image-forming unit is installed, the area being divided into a front area and a rear area in a predetermined front-to-rear direction, the image-forming portion having a front image-forming portion that is located on a front side of the image-forming unit and a rear image-forming portion that is located on a rear side of the image-forming unit, the front image-forming portion being projected on to the front area and the rear image-forming portion being projected onto the rear area;

an image-scanning portion that scans an image from an original document while conveying the original document, the image-scanning portion being disposed on the front side of the image-forming unit in the predetermined front-to-rear direction, the image-scanning portion being projected in the front area, the image-forming portion forming an image on a recording medium based on image data read by the image-scanning portion;

a control panel that enables a user to control the image-scanning portion and the image-forming portion, the control panel being disposed on the front side of the image-forming unit in the predetermined front-to-rear direction, the control panel being projected in the front area, the control panel and the image-scanning portion being arranged in vertical alignment with the front image-forming portion on the front area;

a cover that is provided integrally with the control panel and that covers the image-scanning portion; and an original document supply tray disposed on a rear side of the image-scanning portion in the front-to-rear direction at a slant to the horizontal for receiving an original document to be supplied to the image-scanning portion.

2. An image-forming device according to claim 1, wherein the image-forming unit further includes a recording medium supplying portion that is disposed below the image-forming portion and that accommodates a recording medium and supplies the recording medium to the image-forming portion.

3. An image-forming device, comprising:

an image-forming unit that includes an image-forming portion that forms an image on a recording medium, the image-forming unit being projected down onto an area in which the image-forming unit is installed, the area being divided into a front area and a rear area in a predetermined front-to-rear direction;

an image-scanning portion that scans an image from an original document, the image-scanning portion being disposed on a front side of the image-forming unit in the predetermined front-to-rear direction, the image-scanning portion being projected in the front area, the image-forming portion forming an image on a recording medium based on image data read by the image-scanning portion;

a control panel that enables a user to control the image-scanning portion and the image-forming portion, the control panel being disposed on the front side of the image-forming unit in the predetermined front-to-rear direction, the control panel being projected in the front area; and a cover that is provided integrally with the control panel and that covers the image-scanning portion;

wherein the image-forming unit has a front side and a rear side, the front-to-rear direction extending from the front side to the rear side, a rear-to-front direction being defined to extend from the rear side to the front side, wherein the image-forming unit further includes a recording medium discharging portion that discharges a recording medium in the rear-to-front direction, the recording medium discharging portion discharging a recording medium so that the trailing edge of the discharged recording medium is farther rearward than a rear end of the image-scanning portion, while the leading edge of the discharged recording medium is farther forward than a front end of the image-scanning portion.

4. An image-forming device according to claim 3, wherein the image-forming portion forms an image on a recording medium while the recording medium is conveyed in the front-to-rear direction.

5. An image-forming device according to claim 3, further comprising an original document feeding unit that is disposed on a rear side of the image-scanning portion and that feeds an original document; and an original document discharging unit that is disposed on a front side of the image-scanning portion and that discharges an original document.

6. An image-forming device according to claim 5, further comprising an original document discharge tray provided on the cover and capable of swinging open with respect to the control panel for receiving an original document discharged from the image-scanning portion;

wherein the original document discharge tray receives an original document in an open state with respect to the control panel, the original document discharge tray having an opening that enables the document to be discharged forward through the opening and the control panel to be operated through the opening when the original document discharge tray is in a closed state with respect to the control panel.

7. An image-forming device according to claim 6, wherein the cover has a holding portion, at which the original document discharge tray is held by the cover and from which the original document discharge tray separates upon receipt of an impact.

8. An image-forming device according to claim 3, further comprising an original document supply tray disposed on a rear side of the image-scanning portion in the front-to-rear direction at a slant to the horizontal for receiving an original document to be supplied to the image-scanning portion.

9. An image-forming device according to claim 3, wherein the image-forming portion forms an image on a recording medium while the recording medium is conveyed in the front-to-rear direction.

10. An image-forming device according to claim 3, wherein the image-forming unit further includes a recording medium supplying portion that is disposed below the image-forming portion and that accommodates a recording medium and supplies the recording medium to the image-forming portion.

11. An image-forming device according to claim 3, wherein the image-forming unit has a front side and a rear side, the front-to-rear direction extending from the front side to the rear side, a rear-to-front direction being defined to extend from the rear side to the front side, further comprising an original document feeding unit that is disposed on a rear side of the image-scanning portion and that feeds an original document to the image-scanning portion; and an original document discharging unit that is disposed on the rear side of the image-scanning portion and below the original document feeding unit and that discharges an original document.

12. An image-forming device according to claim 11, further comprising an original document discharge tray that receives an original document discharged from the original document discharging unit and that has a depression formed in one side edge along a widthwise direction that is substantially perpendicular to the front-to-rear direction to enable a user to grip the original document on both surfaces.

13. An image-forming device according to claim 3, further comprising an original document feeding unit that is disposed on a rear side of the image-scanning portion and that feeds an original document; and an original document discharging unit that is disposed on a front side of the image-scanning portion and that discharges an original document.

14. An image-forming device according to claim 13, further comprising an original document discharge tray provided on the cover and capable of swinging open with respect to the control panel for receiving an original document discharged from the image-scanning portion;

wherein the original document discharge tray receives an original document in an open state with respect to the control panel, the original document discharge tray having an opening that enables the document to be discharged forward through the opening and the control panel to be operated through the opening when the original document discharge tray is in a closed state with respect to the control panel.

15. An image-forming device according to claim 14, wherein the cover has a holding portion, at which the original document discharge tray is held by the cover and from which the original document discharge tray separates upon receipt of an impact.

16. An image-forming device according to claim 3, wherein the image-forming unit has a front side and a rear side, the front-to-rear direction extending from the front side to the rear side, a rear-to-front direction being defined to extend from the rear side to the front side, wherein the image-forming portion includes a developing device that forms an image electrophotographically; and wherein the image-forming unit has a front cover at the front side thereof, the front cover being openable and closable, the developing device being inserted to and removed from the image-forming unit through the opened cover.

17. An image-forming device, comprising:

an image-forming unit that includes an image-forming portion that forms an image on a recording medium, the image-forming unit being projected down onto an area in which the image-forming unit is installed, the area being divided into a front area and a rear area in a predetermined front-to-rear direction;

an image-scanning portion that scans an image from an original document, the image-scanning portion being disposed on a front side of the image-forming unit in the predetermined front-to-rear direction, the image-scanning portion being projected in the front area, the image-forming portion forming an image on a recording medium based on image data read by the image-scanning portion;

a control panel that enables a user to control the image-scanning portion and the image-forming portion, the control panel being disposed on the front side of the image-forming unit in the predetermined front-to-rear direction, the control panel being projected in the front area; and a cover that is provided integrally with the control panel and that covers the image-scanning portion;

wherein the image-forming unit has a front side and a rear side, the front-to-rear direction extending from the front side to the rear side, a rear-to-front direction being defined to extend from the rear side to the front side, further comprising an original document feeding unit that is disposed on a rear side of the image-scanning portion and that feeds an original document to the image-scanning portion; and an original document discharging unit that is disposed on the rear side of the image-scanning portion and below the original document feeding unit and that discharges an original document.

18. An image-forming device according to claim 17, further comprising an original document discharge tray that receives an original document discharged from the original document discharging unit and that has a depression formed in one side edge along a widthwise direction that is substantially perpendicular to the front-to-rear direction to enable a user to grip the original document on both surfaces.

19. An image-forming device, comprising:

an image-forming unit that includes an image-forming portion that forms an image on a recording medium, the image-forming unit being projected down onto an area in which the image-forming unit is installed, the area being divided into a front area and a rear area in a predetermined front-to-rear direction;

an image-scanning portion that scans an image from an original document, the image-scanning portion being disposed on a front side of the image-forming unit in the predetermined front-to-rear direction, the image-scanning portion being projected in the front area, the image-forming portion forming an image on a recording medium based on image data read by the image-scanning portion;

a control panel that enables a user to control the image-scanning portion and the image-forming portion, the control panel being disposed on the front side of the image-forming unit in the predetermined front-to-rear direction, the control panel being projected in the front area; and a cover that is provided integrally with the control panel and that covers the image-scanning portion;

wherein the image-forming unit has a front side and a rear side, the front-to-rear direction extending from the front side to the rear side, a rear-to-front direction being defined to extend from the rear side to the front side, wherein the image-forming portion includes a developing device that forms an image electrophotographically; and wherein the image-forming unit has a front cover at the front side thereof, the front cover being openable and closable, the developing device being inserted to and removed from the image-forming unit through the opened cover.

20. An image-forming device, comprising:

an image-scanning portion that scans an image from an original document, the image-scanning portion including a document conveying portion that conveys the original document in a direction defined between a predetermined front side and a predetermined rear side of the image-scanning portion;

an image-forming unit that includes an image-forming portion that forms an image on a recording medium based on image data read by the image-scanning portion;

an original document supply tray that receives an original document to be supplied to the image-scanning portion;

an original document discharge tray that receives an original document discharged from the image-scanning portion;

a recording medium supply tray that receives a recording medium to be supplied to the image-forming portion; and a recording medium discharge tray that receives a recording medium discharged from the image-forming portion;

the original document supply tray, the original document discharge tray, the recording medium discharge tray, the image-forming portion, and the recording medium supply tray being arranged in a vertical alignment, wherein the recording medium supply tray is detachably provided on the image-forming unit;

wherein the direction in which the original document is conveyed in the image-scanning portion, the direction in which the recording medium is conveyed in the image-forming portion, and the direction in which the recording medium supply tray is attached and detached are substantially parallel with each other; and wherein the image-forming portion is disposed below the recording medium discharge tray, and the recording medium supply tray is disposed below the image-forming portion.

21. An image-forming device according to claim 20, wherein the image-scanning portion includes a document-scanning portion that scans an original document supplied from the original document supply tray, an inverting portion that inverts the original document, and a discharging portion that discharges the original document onto the original document discharge tray.

22. An image-forming device according to claim 20, wherein the image-scanning portion is disposed on a front side of the image-forming unit;

the original document supply tray is disposed on a rear side of the image-scanning portion; and the original document discharge tray is disposed below the original document supply tray.

23. An image-forming device according to claim 20, wherein the recording medium discharge tray is disposed below the original document discharge tray.

24. An image-forming device according to claim 20, wherein a front-to-rear direction is defined to extend from the front side to the rear side of the image-scanning portion, a rear-to-front direction being defined to extend from the rear side to the front side of the image-scanning portion, and wherein the document conveying portion includes:

a conveying portion that conveys the original document along a conveying path from the original document supply tray to the original document discharge tray, the conveying path extending from the original document supply tray in the rear-to-front direction and further extending in the front-to-rear direction to the original document discharge tray; and a document-scanning portion that scans the original document while the original document is being conveyed along the conveying path.

25. An image-forming device, comprising:

an image-scanning portion that scans an image from an original document while conveying the original document;

an image-forming unit that includes an image-forming portion that forms an image on a recording medium based on image data read by the image-scanning portion, the image-forming unit having a front side and a rear side, a front-to-rear direction being defined to extend from the front side to the rear side and a rear-to-front direction being defined to extend from the rear side to the front side, the image-forming portion having a front image-forming portion that is located on the front side of the image-forming unit and a rear image-forming portion that is located on the rear side of the image-forming unit;

a control panel that enables a user to control the image-scanning portion and the image-forming portion, the image-scanning portion and the control panel being disposed on the front side of the image-forming unit, the control panel and the image-scanning portion being arranged in vertical alignment with the front image-forming portion;

a cover that is provided integrally with the control panel and that covers the image-scanning portion;

an original document supply tray disposed on a rear side of the image-scanning portion in the front-to-rear direction at a slant to the horizontal for receiving an original document to be supplied to the image-scanning portion.

* * * * *